US010119238B2

(12) United States Patent
Doudican et al.

(10) Patent No.: US 10,119,238 B2
(45) Date of Patent: Nov. 6, 2018

(54) REINFORCED SYNTACTIC STRUCTURE

(71) Applicant: Cornerstone Research Group, Inc., Miamisburg, OH (US)

(72) Inventors: Bradley M. Doudican, Dayton, OH (US); Mitchell D. Bauer, Dayton, OH (US)

(73) Assignee: Cornerstone Research Group, Inc., Miamisburg, OH (US)

( * ) Notice: Subject to any disclaimer, the term of this patent is extended or adjusted under 35 U.S.C. 154(b) by 159 days.

(21) Appl. No.: 15/324,081

(22) PCT Filed: Jul. 7, 2015

(86) PCT No.: PCT/US2015/039366
§ 371 (c)(1),
(2) Date: Jan. 5, 2017

(87) PCT Pub. No.: WO2016/007503
PCT Pub. Date: Jan. 14, 2016

(65) Prior Publication Data

US 2017/0211254 A1 Jul. 27, 2017

Related U.S. Application Data

(60) Provisional application No. 62/021,485, filed on Jul. 7, 2014.

(51) Int. Cl.
*E02D 31/00* (2006.01)
*E02D 5/64* (2006.01)
(Continued)

(52) U.S. Cl.
CPC ..... *E02D 31/00* (2013.01); *E02D 5/64* (2013.01); *E04C 3/34* (2013.01); *E04C 5/07* (2013.01);
(Continued)

(58) Field of Classification Search
CPC ..... E02D 31/00; E02D 5/64; E04C 5/07
See application file for complete search history.

(56) References Cited

U.S. PATENT DOCUMENTS 2,636,354 A 4/1953 Glassgold
3,736,759 A * 6/1973 Blose ..... E02D 5/60 264/45.3
(Continued)

FOREIGN PATENT DOCUMENTS

EP 0370147 A1 5/1990
EP 2211003 A1 7/2010
(Continued)

OTHER PUBLICATIONS

International Search Report and Written Opinion pertaining to PCT/US2015/039366 dated Sep. 4, 2015.
(Continued)

*Primary Examiner* — Tara Mayo-Pinnock
(74) *Attorney, Agent, or Firm* — Dinsmore & Shohl LLP

(57) ABSTRACT

Embodiments of the present disclosure are directed to reinforced syntactic structures and methods of forming the same to encase an underlying structural substrate for remediation and/or improve structural stability. The reinforced syntactic structure includes an underlying structural substrate having an outer surface and at least one reinforcement shell. The reinforcement shell is formed from at least one syntactic foam shell layer encasing at least a portion of the outer surface of the underlying structural substrate and at least one rigid noncorrosive stiffening skin coupled to the syntactic foam shell layer. The syntactic foam shell layer includes at least two opposing subshells wrapped around the underlying structural substrate and the rigid noncorrosive stiffening skin includes at least two opposing skin sections attached to the at least two opposing subshells respectively. The syntactic
(Continued)

foam shell layer is formed from syntactic foam which includes hollow microspheres disposed within a resin matrix.

20 Claims, 7 Drawing Sheets

(51) Int. Cl.
*E04G 23/02* (2006.01)
*E04H 12/22* (2006.01)
*E04C 3/34* (2006.01)
*E04C 5/07* (2006.01)

(52) U.S. Cl.
CPC ..... *E04G 23/0218* (2013.01); *E04G 23/0225* (2013.01); *E04H 12/2292* (2013.01); *E02D 2200/1607* (2013.01); *E02D 2300/002* (2013.01); *E02D 2300/0025* (2013.01); *E02D 2300/0026* (2013.01); *E02D 2300/0046* (2013.01); *E02D 2300/0071* (2013.01)

(56) References Cited

U.S. PATENT DOCUMENTS 4,019,301 A * 4/1977 Fox ..... E02D 5/60 405/216
4,058,985 A * 11/1977 Liddell ..... E02D 5/60 405/216
4,244,156 A * 1/1981 Watts, Jr. ..... E02D 5/226 264/46.5
4,464,082 A * 8/1984 Isaacs ..... E02D 31/14 138/105
5,505,030 A 4/1996 Michalcewiz et al.
6,827,110 B2 12/2004 Watkins
7,744,314 B2 * 6/2010 Eide ..... E21B 17/012 166/350
8,281,545 B2 10/2012 Choi
8,443,896 B2 * 5/2013 Howard ..... E21B 17/012 166/345
8,628,275 B1 1/2014 Trader et al.
8,713,891 B2 * 5/2014 Carr ..... E04G 23/0218 52/745.17
2001/0043991 A1 11/2001 Watkins
2003/0000152 A1 * 1/2003 Ryan ..... E01F 15/0469 52/3
2003/0085482 A1 5/2003 Sincock et al.
2011/0017340 A1 1/2011 Mirossay et al.
2013/0084433 A1 4/2013 Ernst

FOREIGN PATENT DOCUMENTS

JP 58123927 7/1983
WO 2010074680 A1 7/2010
WO 2013102274 A1 7/2013

OTHER PUBLICATIONS

International Preliminary Report on Patentability pertaining to PCT/US2015/039366 dated Jan. 10, 2017.

* cited by examiner

REINFORCED SYNTACTIC STRUCTURE

CROSS REFERENCE TO RELATED APPLICATION

This application claims the benefit of U.S. Application Ser. No. 62/021,485 filed Jul. 7, 2014, which is incorporated by reference herein in its entirety.

TECHNICAL FIELD

The present disclosure is generally related to syntactic foam systems and specifically related to syntactic foam systems configured to encase, support and remediate an underlying structural substrate.

BACKGROUND

In the construction industry, maintaining the strength of load bearing support members is a key consideration. Throughout the World, steel and concrete structures are exposed to harsh environmental and working conditions. Steel, concrete, and other common materials may be damaged and deteriorate from being exposed to harsh environmental conditions or rough working conditions. For example, concrete may experience spalling or cracking and steel may corrode from being exposed to the environment. Additionally, concrete, steel, and other materials also may experience wear and impacts by foreign objects as a function of their use in applications where rough working conditions are experienced. In the mining industry, for example, a stockpile cover in a gold mine is impacted with rocks and other abrasive materials, thus maintaining the strength of load bearing support members of the stockpile cover is a key consideration. The need for maintenance of the strength of load bearing support members is common in numerous other structural applications. Corrosion, abrasion, and other environmental conditions may cause holes, a reduction in thickness, or other damage and wear that reduce the strength and efficacy of the support members.

Existing encasement, wrapping, or jacket-type support member protection solutions in the industry address ductility or axial capacity of a support member via confinement or protection against future corrosion. For example, the use of a glass or carbon fiber composite wrapped around a concrete column. The fiberglass composite thus provides reinforcement and improves the axial capacity of short columns and eliminates the brittle failure mode of the concrete by confinement. However, existing jacket-type support member protection systems offer no lightweight solution to address stability or buckling capacity of a support member, especially long structural members where design capacity is controlled by buckling. Additionally, existing solutions are often non-structural and merely serve as a protective barrier for a damaged support member.

Thus, there is a continual need for methods and systems which reinstate the structural capacity and protect deteriorated support members as well as offer solutions to address stability and buckling capacity of a support member.

SUMMARY

Embodiments of the present disclosure are directed to syntactic foam systems and specifically syntactic foam systems configured to encase and support an underlying structural substrate.

In accordance with an embodiment, a reinforced syntactic structure is disclosed. The reinforced syntactic structure includes an underlying structural substrate having an outer surface and at least one reinforcement shell. The reinforcement shell includes at least one low density syntactic foam shell layer and at least one rigid non-corrosive stiffening skin coupled to the syntactic foam shell layer. The syntactic foam shell layer encases at least a portion of the outer surface of the underlying structural substrate and has an unconfined compressive strength of about 500 to about 20,000 psi. Additionally, the syntactic foam shell layer includes at least two opposing subshells wrapped around the underlying structural substrate. Each opposing subshell has at least two ends attached to two respective ends of at least one of the remaining opposing subshells. Further, the rigid non-corrosive stiffening skin has a Young's modulus of 10 GPa to 250 GPa. The rigid non-corrosive stiffening skin includes at least two opposing skin sections attached to the at least two opposing subshells respectively. Each opposing skin section includes at least two ends attached to two respective ends of at least one of the remaining opposing skin sections. Finally, the syntactic foam shell layer is formed with hollow microspheres, also known as microballoons, disposed within a thermosetting or thermoplastic resin matrix.

In accordance with another embodiment, a reinforcement shell is disclosed. The reinforcement shell includes at least one syntactic foam shell layer configured to encase at least a portion of an outer surface of an underlying structural substrate. The syntactic foam shell layer has an unconfined compressive strength of about 500 to about 20,000 psi. Further, the syntactic foam shell layer includes at least two opposing subshells configured to wrap around the underlying structural substrate, wherein each opposing subshell has at least two ends attached to two respective ends of at least one of the remaining opposing subshells. The reinforced syntactic structure also includes at least one rigid non-corrosive stiffening skin coupled to the syntactic foam shell layer. The rigid non-corrosive stiffening skin has a Young's modulus of 10 GPa to 250 GPa. Additionally, the rigid non-corrosive stiffening skin includes at least two opposing skin sections attached to the at least two opposing subshells respectively, wherein each opposing skin section comprises at least two ends attached to two respective ends of at least one of the remaining opposing skin sections. Finally, the syntactic foam shell layer is formed from hollow microspheres disposed within a thermosetting or thermoplastic resin matrix.

In accordance with yet another embodiment, a method of encasing an underlying structural substrate to improve stability is disclosed. The method of encasing an underlying structural substrate to improve stability includes attaching at least one reinforcement shell around the underlying structural substrate by joining at least two opposing subshells, thereby enclosing the underlying structural substrate. The reinforcement shell includes at least one syntactic foam shell layer formed from at least two opposing subshells and at least one rigid non-corrosive stiffening skin coupled to the syntactic foam shell layer. Each opposing subshell includes at least two ends attached to two respective ends of at least one of the remaining opposing subshells. Further the at least one syntactic foam shell layer has an unconfined compressive strength of about 500 to about 20,000 psi. Additionally, the rigid non-corrosive stiffening skin includes at least two opposing skin sections attached to the at least two opposing subshells respectively. Each opposing skin section has at least two ends attached to two respective ends of at least one of the remaining opposing skin sections. Further, the at least one rigid non-corrosive stiffening skin coupled to the syntactic foam shell layer has a Young's modulus of 10 GPa to 250 GPa. The method also includes securing the at least one reinforcement shell around the underlying structural substrate by joining the at least two ends of the syntactic foam layer opposing subshells together, fastening or welding the at least two ends of the opposing skin sections together, and adhering an inner surface of the syntactic foam layer to an outer surface of the underlying structural substrate.

BRIEF DESCRIPTION OF THE DRAWINGS

The following detailed description of specific embodiments of the present disclosure can be best understood when read in conjunction with the drawings enclosed herewith.

Figure 1:
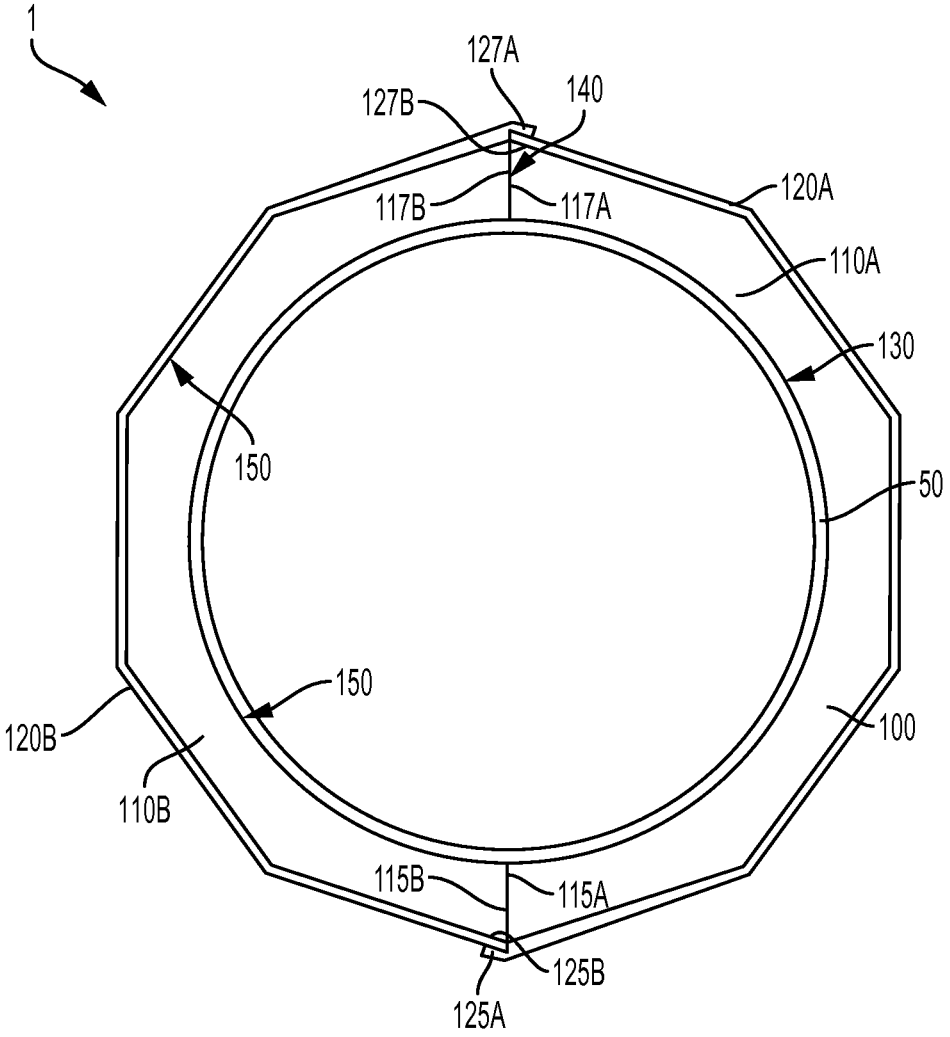
FIG. 1 is a cross-sectional view of a reinforced syntactic structure having a two part reinforcement shell encasing an underlying structural substrate according to one or more embodiments of the present disclosure.

The embodiments set forth in the drawings are illustrative in nature and not intended to be limiting of the invention defined by the claims. Moreover, individual features of the drawings will be more fully apparent and understood in view of the detailed description.

DETAILED DESCRIPTION

Referring to FIG. 1, a reinforced syntactic structure 1 comprises an underlying structural substrate 50 having an outer surface, and at least one reinforcement shell 80. The at least one reinforcement shell 80 includes at least one syntactic foam shell layer 100 encasing at least a portion of the outer surface of the underlying structural substrate 50 and at least one rigid non-corrosive stiffening skin 120 coupled to the at least one syntactic foam shell layer 100.

The at least one syntactic foam shell layer 100 includes at least two attached opposing subshells 110A, 110B wrapped around the underlying structural substrate 50. Each opposing subshell 110A comprises at least two ends 115A, 117A attached to two respective ends 115B, 117B of the other opposing subshell 110B.

In embodiments, the ends 115A, 117A, 115B, 117B of the opposing subshells 110A, 110B of the syntactic foam shell layer 100 are joined together. In at least one embodiment, the ends 115A, 117A, 115B, 117B of the opposing subshells 110A, 110B of the syntactic foam shell layer 100 are adhered together with an adhesive at an interface 140 of the respective ends (115A/115B, 117A/117B). As it is being utilized in a support structure, the adhesive must have sufficient strength. In embodiments, the adhesive may have a lap shear strength of 500 psi to 4,400 psi, or about 2,000 psi to 4,000 psi. Two specific, non-limiting, exemplary acrylic adhesives includes 3M DP825 (3M Company, St. Paul, Minn., USA) and Extreme Adhesives 5375HS (Extreme Adhesives, Inc., Raymond, N.H., USA). In further embodiments, the ends of the opposing subshells 110A, 110B of the syntactic foam shell layer 100 are joined together by a mechanical fastener.

The at least one syntactic foam shell layer 100 demonstrates an unconfined compressive strength of about 500 to about 20,000 psi. In further embodiments, the syntactic foam shell layer 100 has an unconfined compressive strength of about 1,000 to about 11,500 psi.

Additionally as shown in FIG. 1, the reinforced syntactic structure 1 comprises at least one rigid non-corrosive stiffening skin 120 disposed over the syntactic foam shell layer 100. The rigid non-corrosive stiffening skin 120 is desirably non-corrosive because, in many embodiments, it will be exposed to weather and environmental conditions that can cause rusting or other destructive phenomenon.

The rigid non-corrosive stiffening skin 120 may comprise stainless steel, galvanized steel, or aluminum. Alternatively, the rigid non-corrosive stiffening skin 120 may comprise carbon fiber reinforced or glass fiber reinforced polymer composite. The rigid non-corrosive stiffening skin 120 may have yield strength of 30,000 psi to 400,000 psi, or from 30,000 psi to 75,000 psi, or about 30,000 psi to 50,000 psi.

The rigidity of the rigid non-corrosive stiffening skin 120 is beneficial in providing buckling resistance. The syntactic foam shell layer 100 without the rigid non-corrosive stiffening skin 120 may be too elastic. The axial capacity of the reinforced syntactic structure 1 is influenced by the buckling resistance of the rigid non-corrosive stiffening skin 120, the reinforcement shell 80 combining the rigid non-corrosive stiffening skin 120 and the syntactic foam shell layer 100, and the reinforced syntactic structure 1 as a whole. In the present embodiment, the rigid non-corrosive stiffening skin 120 may have a Young's modulus of 10 GPa to 250 GPa, or from 60 GPa to 210 GPa.

As shown in FIG. 1, each opposing skin section 120A comprises at least two ends 125A, 127A attached to two respective ends 125B, 127B of the other opposing skin section 120B. Referring to FIGS. 2-6, at least one end 125A of opposing skin section 120A may be a flanged end 125A for coupling with an opposing skin section 120B. As shown in FIG. 1, flanged end 125A of opposing skin section 120A overlaps with end 125B of opposing skin section 120B for fastening therebetween. In an additional embodiment, flanged end 127A of opposing skin section 120B may additionally overlap with end 127B of opposing skin section 120A for redundant fastening. While the figures depict coupling at the flanged ends, other suitable fastening options are contemplated herein. In various embodiments the fastening of the opposing skin sections 120A, 120B together is achieved with, for example, adhesive, mechanical fasteners, or welding. For example, the opposing subshells 110A, 110B of the syntactic foam shell layer 100 may also be welded together between the flanged ends 127A, 127B of the opposing stiffening skin sections of the respective opposing subshells 110A, 110B.

The rigid non-corrosive stiffening skin 120 is attached to the syntactic foam opposing subshells 110A, 110B by an adhesive 150 to form a reinforcement shell 80. In addition to the adhesive 150, the opposing skin sections 120A, 120B of the rigid non-corrosive stiffening skin 120 may also be attached to the syntactic foam opposing subshells 110A, 110B by fasteners such as bolts, screws, or combinations thereof. Additionally, the opposing subshells 110A, 110B of the syntactic foam shell layer 100 may also be fastened together, either with the fastener of the rigid non-corrosive stiffening skin 120 or another fastener.

Figure 4:
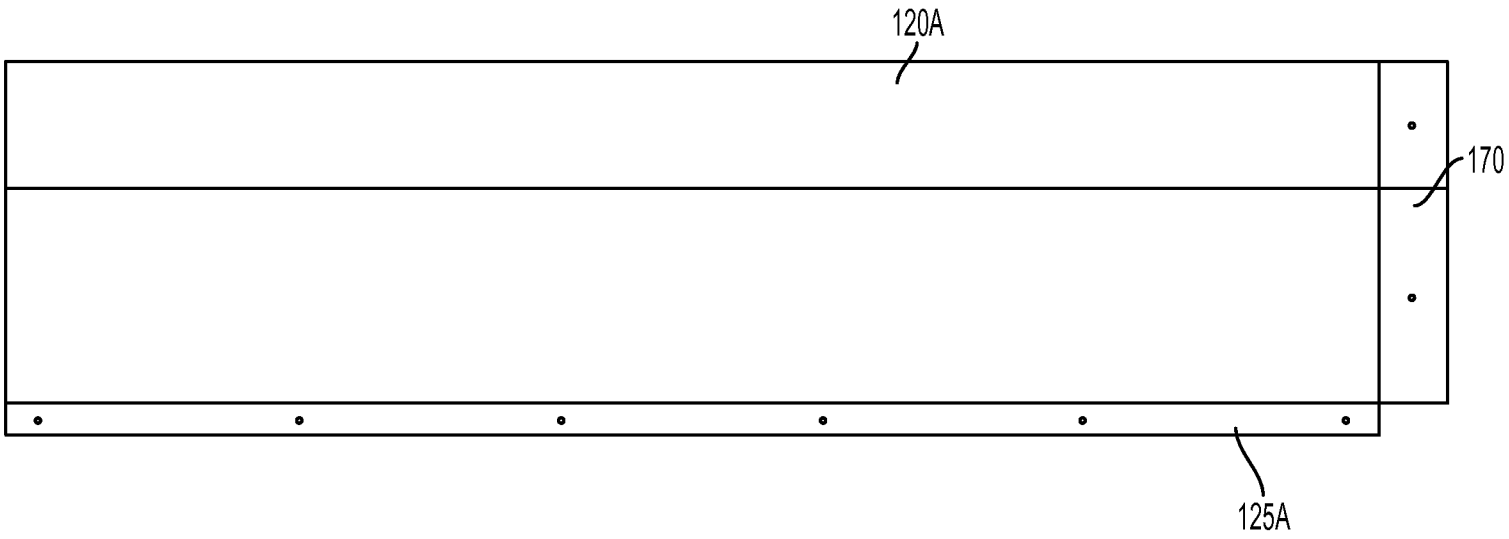
FIG. 4 is a side partial view of the subshell of FIG. 2 according to one or more embodiments of the present disclosure.
Figure 7:
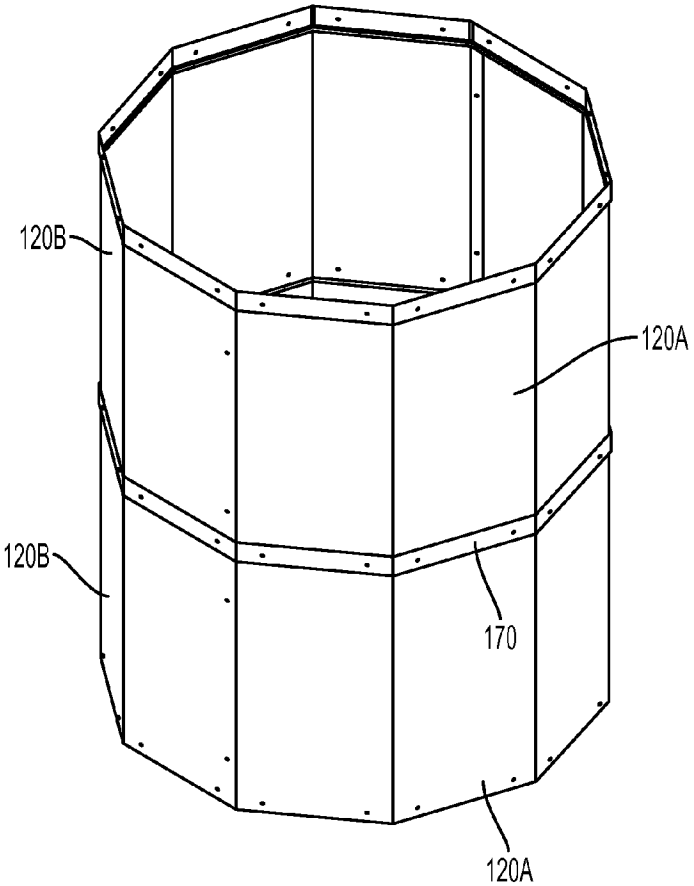
FIG. 7 is a perspective view of the non-corrosive stiffening skin attached to adjacent non-corrosive stiffening skins vertically and horizontally according to one or more embodiments of the present disclosure.
Figure 6:
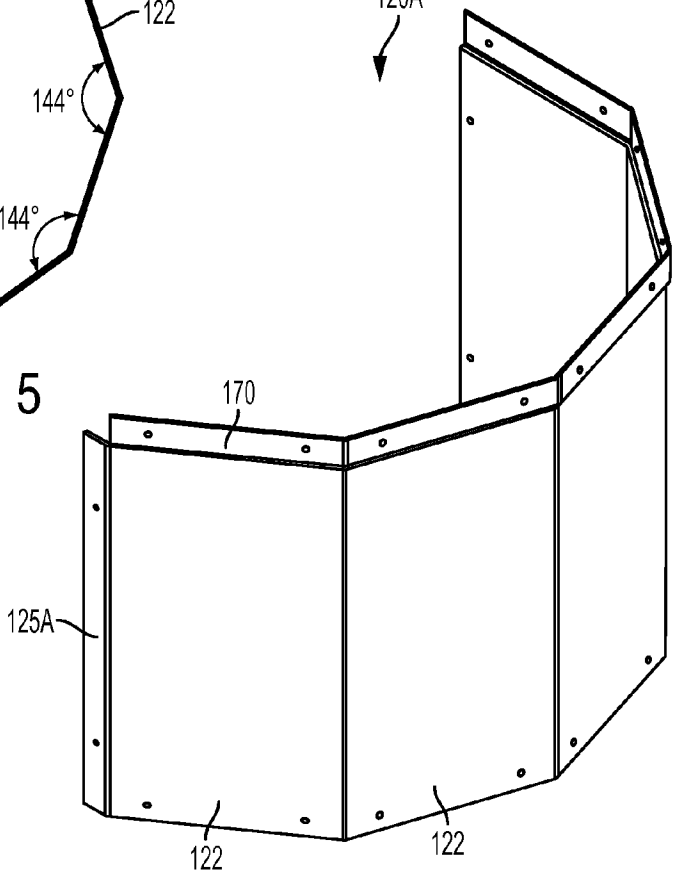
FIG. 6 is a perspective view of an opposing skin section of the non-corrosive stiffening skin according to one or more embodiments of the present disclosure.

The encasing of the underlying structural substrate 50 as depicted in FIG. 1 involves the horizontal attachment of the syntactic foam opposing subshells 110A, 110B and opposing skin sections 120A, 120B of the rigid non-corrosive stiffening skin 120, and also involves the vertical attachment of the opposing skin sections 120A, 120B as depicted in FIG. 7. As shown in FIGS. 4, 6, and 7, the opposing skin sections 120A, 120B include an upper flanged end 170 for fastening to a vertically adjacent opposing skin section 120A, 120B.

Figure 5:
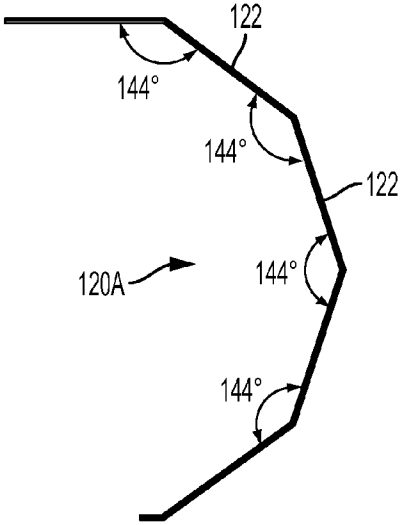
FIG. 5 is a top view of an opposing skin section of the non-corrosive stiffening skin according to one or more embodiments of the present disclosure.

With reference to FIGS. 5 and 6, in embodiments, the rigid non-corrosive stiffening skin 120 comprises a series of plates 122. The opposing skin sections 120A, 120B, when combined together, form a complete annular structure comprising a series of flat sections formed from the plates 122. In embodiments, the rigid non-corrosive stiffening skin 120 forms a polygon with "n"-sides, wherein each side is formed by a plate 122. In various embodiments, "n" is 3, 4, 5, 6, 8, 10, 12, 50, or any other integer value. For example, in FIGS. 5-7, "n" is 10 which results in an interior angle between plates 122 of 144°. The interior angle will vary based on the value of "n" and the geometry of the underlying structural substrate 50. The number of plates 122 utilized may vary depending on the size of the underlying structural substrate 50, with a larger underlying structural substrate 50 necessitating more plates 122. Further, the number of plates 122 utilized may vary depending on aesthetic considerations of the complete reinforced syntactic structure 1, with increased number of plates 122 forming a more true circle. Additionally, the number of plates 122 may vary to match the geometries of the underlying structural substrate 50. In another embodiment, the non-corrosive stiffening skin 120 forms a cylinder formed from a plurality of semi-cylindrical opposed skin sections 120A, 120B with two flat flanged ends 125A, 127A for attachment with the remaining opposed skin sections 120A, 120B. The syntactic foam shell layer 100 generally has an outer geometry which reflects the geometry of the opposing skin sections 120A, 120B formed from a series of plates 122 to allow connection of the rigid non-corrosive stiffening skin 120 and the syntactic foam shell layer 100.

The underlying structural substrate 50 may comprise various structures, for example, a tube, beam, pillar, column, plate, strut, pipe, tank, or pressure vessel. The underlying structural substrate 50 may also comprise various materials including metal, concrete, wood, masonry, or combinations thereof, and generally are structures more susceptible to harsh environmental conditions.

Various structures and dimensions are also contemplated for the opposing subshells 110A, 110B and opposing skin sections 120A, 120B of the rigid non-corrosive stiffening skin 120. The strength required and the shape of the underlying structural substrate 50 encased by the opposing subshells 110A, 110B and opposing skin sections 120A, 120B dictate the shape of the opposing subshells 110A, 110B and opposing skin sections 120A, 120B. As shown in FIG. 1, the opposing subshells 110A, 110B and opposing skin sections 120A, 120B may comprise identical or mirrored shapes. In the specific embodiment of FIG. 1, the opposing subshells 110A, 110B and opposing skin sections 120A, 120B have hollow semi-cylindrical inner surfaces 130 which encase a cylindrical tube underlying structural substrate 50. Various layer thicknesses are also contemplated. For example, the syntactic foam shell layer 100 may have a thickness of 0.25 inches to 6 inches. Moreover, the thickness of the rigid non-corrosive stiffening skin 120 may be between 0.05 inches to 0.5 inches, or from 0.1 inches to 0.4 inches.

Figure 2:
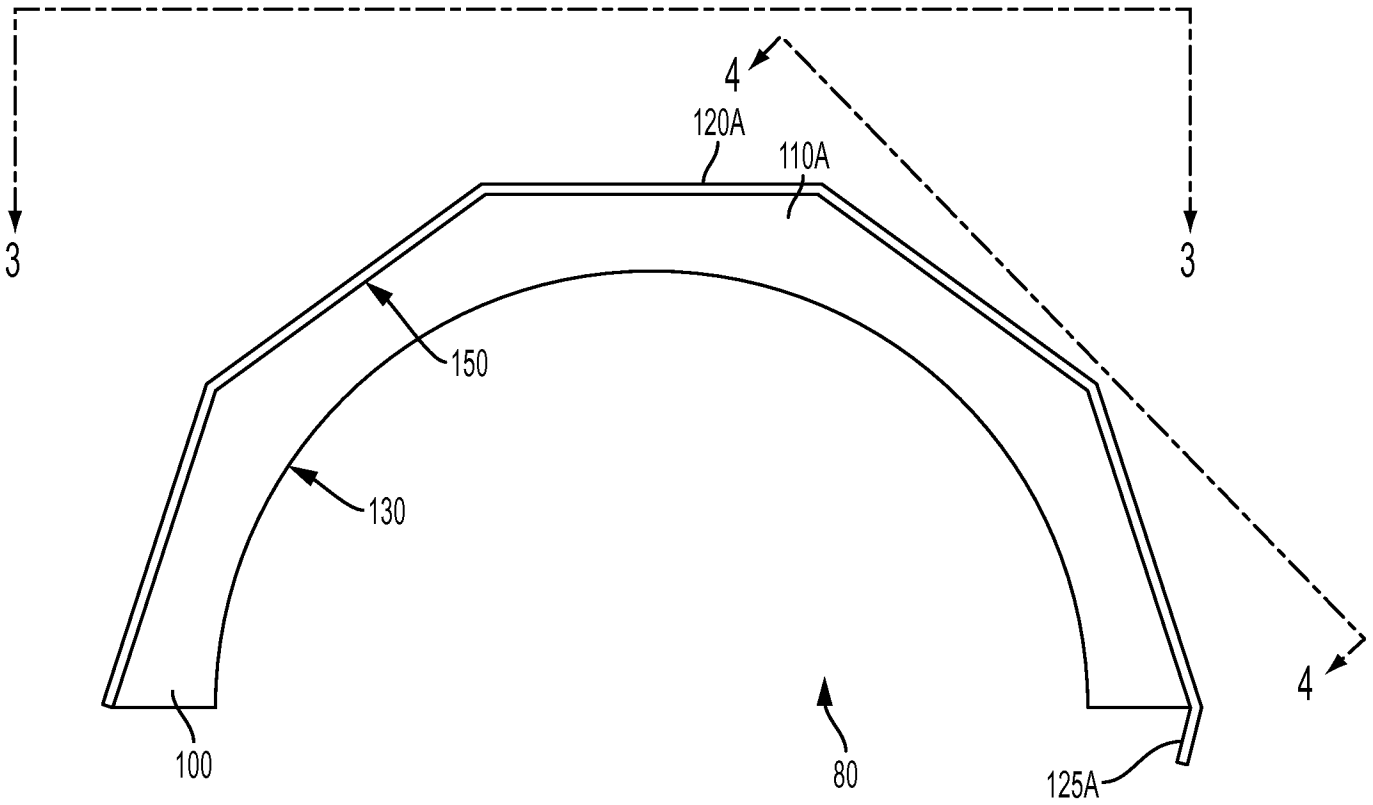
FIG. 2 is a cross-sectional view of one of the subshells of the reinforcement shell layer depicted in FIG. 1 according to one or more embodiments of the present disclosure.
Figure 3:
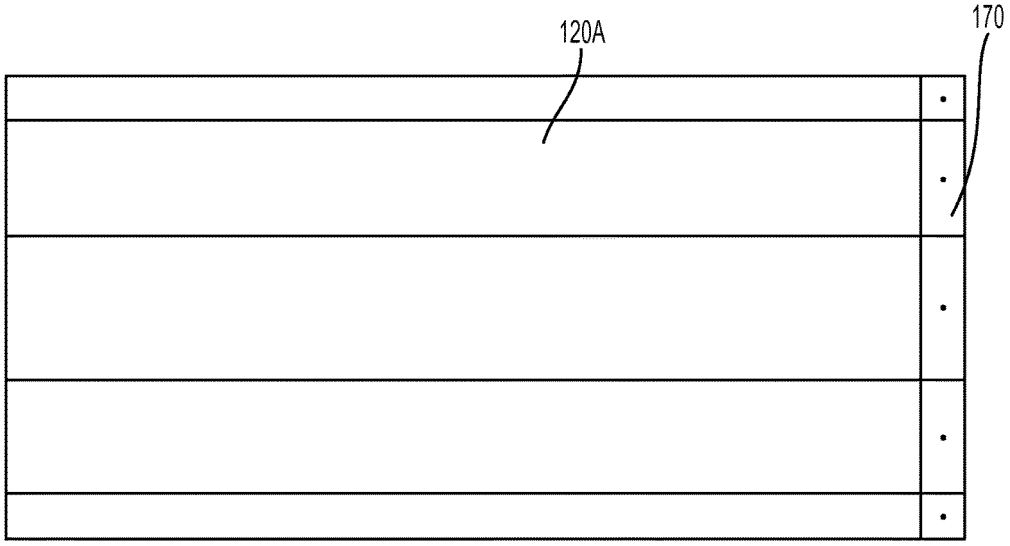
FIG. 3 is a side view of the subshell of FIG. 2 according to one or more embodiments of the present disclosure.

Additionally, with reference to FIGS. 1 and 2, the syntactic foam shell layer 100 includes an inner surface 130 adjacent to the outer surface of the underlying structural substrate 50. Upon assembly of the reinforced syntactic structure and placement of the syntactic foam shell layer 100 around the underlying structural substrate 50, the inner surface 130 of the syntactic foam shell layer 100 is in contact with the underlying structural substrate 50. In other embodiments, the syntactic foam shell layer 100 is affixed to the underlying structural substrate 50. For example, an adhesive layer 150 disposed between the syntactic foam shell layer 100 and the underlying structural substrate 50 may secure the inner surface 130 of the syntactic foam shell layer 100 to the outer surface of the underlying structural substrate 50.

Attachment of the syntactic foam shell layer 100 to the underlying structural substrate 50 with adhesive 150 provides load transfer between the underlying structural substrate 50 and the syntactic foam shell layer 100. The combination of the syntactic foam shell layer 100 and the underlying structural substrate 50 adhered together provides a composite structure. The adhesive 150 utilized to secure the reinforcement shell 80 comprising the syntactic foam shell layer 100 and the rigid non-corrosive stiffening skin 120 to the outer surface of the underlying structural substrate 50 must meet a series of performance requirements. Specifically, the adhesive connection should be capable of long-term adhesive loading sufficient to support the dead load of the reinforcement shell 80. Additionally, the adhesive connection should be capable of increased short-term adhesive loading which accounts for the forces of high wind or other environmental effects causing deflection within the structure. Additionally, the adhesive 150 should be capable of withstanding a variety of temperature ranges to allow for placement of the reinforced syntactic structure 1 in a range of environmental conditions. The syntactic material of the syntactic foam shell layer 100 is an insulating material and will naturally provide an insulative barrier between ambient temperatures and the adhesive interface 150 at the junction of the syntactic foam shell layer 100 and the underlying structural substrate 50. However, the adhesive interface 150 between the rigid non-corrosive stiffening skin 120 and the syntactic foam shell layer 100 is not provided the same insulative barrier.

Various adhesive compositions are contemplated herein. In one embodiment, the adhesive 150 is different compositionally than the resin matrix compositions of the syntactic foam described below. Without being bound by theory, using a different stronger adhesive at the syntactic interface may bolster the mechanical strength of the reinforced syntactic structure 1. For example, and not by way of limitation, the adhesive 150 may comprise epoxy, urethane, acrylate, or combinations thereof. In one embodiment, acrylic adhesives may be used as they demonstrate high strength and stiffness as well as the ability to bond to imperfectly prepared steel surfaces, including those with residual oil or contaminants in small quantities. Additionally, the acrylic adhesive may provide resistance to chemical attack. Two specific, non-limiting, exemplary acrylic adhesives includes 3M DP825 (3M Company, St. Paul, Minn., USA) and Extreme Adhesives 5375HS (Extreme Adhesives, Inc., Raymond, N.H., USA).

As stated above, the reinforcement shell 80 may be able to support a structural load. The syntactic foam shell layer 100 may have a compressive strength of 500 to 20,000 psi, or about 1,000 to 11,500 psi. The syntactic foam shell layer 100 may have a dielectric constant of 1.5 to 10, or about 2.0 to 6.0. The syntactic foam shell layer 100 may have a tensile strength of 1,000 to 6,000 psi, or about 1,500 to 5,000. Further, the syntactic foam shell layer 100 may have a flexural strength of 500 to 8,000 psi, or about 2,000 to 5500 psi.

Further, the syntactic foam shell layer 100 may comprise hollow microspheres disposed within a resin matrix. The hollow microspheres may comprise glass, polymer, ceramic, or combinations thereof, and the resin matrix may comprise cyanate ester, silicone, epoxy, vinyl ester, polyester, polyurethane, phenolic or combinations thereof. In addition to these primary ingredients, the resin matrix may also comprise other resin modifiers, for example, flame retardants, viscosity modifiers, fillers, colorants, or combinations thereof. In one embodiment, the viscosity modifiers comprise fumed silica. In another embodiment, the fillers comprise carbon black, carbon nanofibers, carbon nanotubes, chopped glass fibers, polymer fibers, ceramic particles such as silica, alumina, silicon carbide, aluminum nitride, or ceramic nanoparticles. While the specific industrial application may dictate the compositional amounts, the syntactic foam panel may comprise about 12 to about 36% by wt. hollow microspheres and about 64 to about 88% by wt. resin matrix. In a further embodiment, the syntactic foam shell layer 100 comprises about 12 to about 18% by wt. hollow microspheres. One suitable commercial embodiment of syntactic foam for the syntactic foam shell layer 100 is the Advantic® syntactic foam product, e.g., the Advantic 30D product produced by Cornerstone Research Group. The syntactic foam shell layer 100 may have various sizes and thicknesses depending on the industrial application utilized. In an exemplary embodiment, the thickness may range from about 0.25 to about 6 inches, or from about 0.5 to about 3 inches Further, the glass hollow microspheres may have a density range from 0.10 g/cc to 0.85 g/cc, or from 0.10 to 0.63 g/cc, or from 0.125 g/cc to 0.46 g/cc. Alternatively, glass hollow microspheres may have a crush strength of 250 to 16000 psi and an average diameter of microspheres ranging from 10 micron to 85 microns, or from 20 to 85 microns.

The combination of the high tensile strength rigid non-corrosive stiffening skin 120 and the thick, lightweight, high compressive strength polymer syntactic foam shell layer 100 adhered structurally on the underlying structural substrate 50 (underlying structure to be remediated) provides additional benefits. As previously discussed, the underlying structure serving as the underlying structural substrate 50 can be columns, beams, and plates for example. Other existing jacket-type support member protection solutions in the industry address ductility or axial capacity of the support member via confinement or protection against future corrosion. For example, the use of glass or carbon fiber composite to wrap around a concrete column. The confinement improves axial capacity of short columns and eliminates the brittle failure mode of the concrete. However, existing jacket-type support member protection systems offer no solution to address stability or buckling capacity of a support member, especially long structural members where design capacity is controlled by buckling.

Embodiments of the present disclosure combine a rigid skin in the form of the rigid non-corrosive stiffening skin 120 and a high compressive strength syntactic layer in the form of the syntactic foam shell layer 100 to address stability or buckling capacity. Improving the inherent geometric robustness or area moment of inertia of a given cross section loaded in axial compression and/or flexure improve the stability or buckling capacity of the underlying structural substrate 50 by increasing the allowable capacities for Euler buckling, flexural-torsional buckling, and lateral-torsional buckling. In addition, such arrangement improves the plate stability when the underlying structural substrate 50 is in the form of a plate. This is accomplished by increasing the ability of the cross section to resist local or global lateral deflection under axial load, i.e. via improvement in the moment of inertia. The improvement can be understood by considering the Euler Buckling Equation (column capacity under axial load only), Equation (1):

$$F = \frac{\pi^2 EI}{(KL)^2} \tag{1}$$

wherein F=critical vertical load on the column, E=modulus of elasticity, I=area moment of inertia of cross section of the column, K=column effective length factor, and L=unsupported length of column. From Equation (1), the critical load capacity can be increased by increasing I as L and K can be considered as constants in a remediation scenario and E is dominated by the underlying structure in such scenario. Since I is a function of the distance of the material volume from the neutral axis, the attachment of reinforcement shell disclosed in this invention onto the underlying structure will lead to increase in I, and resulting in improved the load capacity F of the structure.

Further, as a secondary improvement mechanism, the combination of the high tensile strength rigid non-corrosive stiffening skin 120 with the high compressive strength syntactic foam shell layer 100 also improves the hoop stress capacity of the remediated structure by the introduction of additional continuous and stiff material available to resist load. Furthermore, since the syntactic foam of the syntactic foam shell layer 100 can act as an energy absorber via crushing of the resin matrix and hollow microspheres therein, the reinforcement shell 80 placed over the underlying structural substrate 50 can improve impact resistance, ductility, and abrasion resistance in addition to being corrosion resistant.

Figure 8:
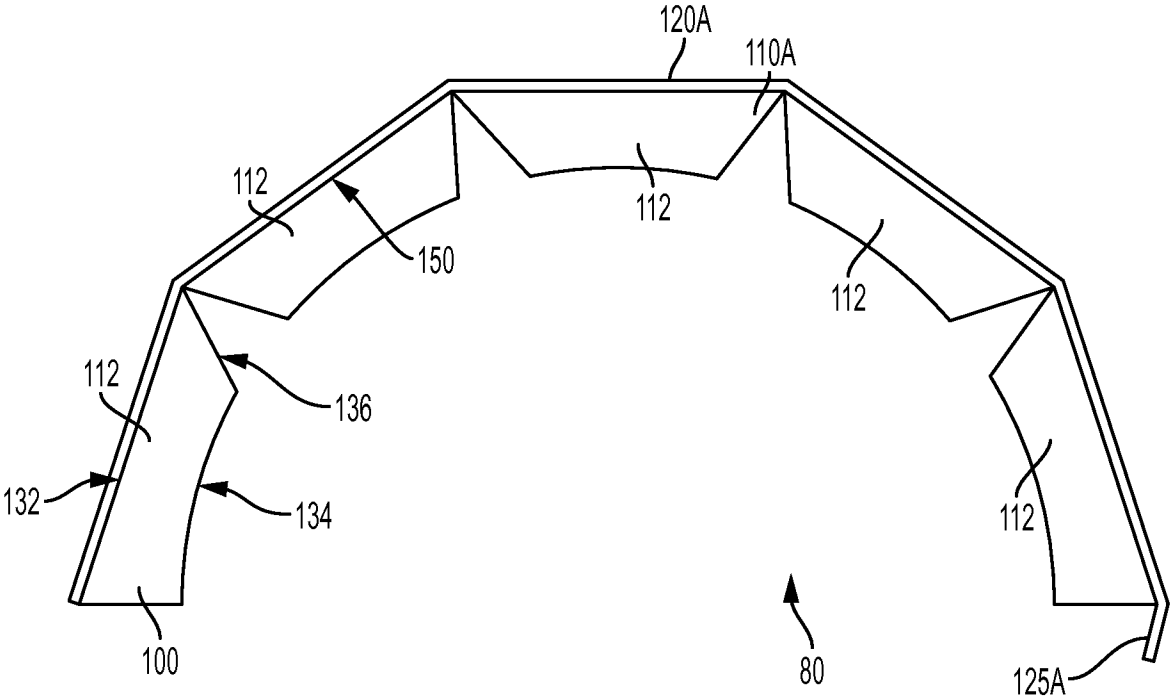
FIG. 8 provides a top view of one of the subshells of the reinforcement shell layer according to one or more embodiments of the present disclosure.

Referring to FIG. 8, the syntactic foam shell layer 100 may comprise a plurality of separate syntactic foam blocks 112 instead of a continuous syntactic foam layer for each of the opposing subshells 110A, 110B. Such design has the benefit of providing flexibility to the reinforcement shell 80 such that the reinforcement shell 80 can be flexed during installation to fit a damaged underlying structural substrate 50 that is not perfectly cylindrical. For such design, the separate syntactic blocks 112 which form the syntactic foam shell layer 100 will have an outer surface 132 conformal to the non-corrosive stiffening skin 120, an inner surface 134 closely matching the outer surface of the underlying structural substrate 50, and lateral surfaces 136 that form an angle between the outer surface 132 and each of the lateral surfaces 136 which is less than ½ the interior angle formed between adjacent plates 122 of the rigid non-corrosive stiffening skin 120. The void formed between adjacent syntactic foam blocks 112 allows for movement and flexion of the reinforcement shell 80 during encasement of the underlying structural substrate 50 during installation.

The reinforcement shell 80 of the reinforced syntactic structure 1, as shown in FIGS. 1 and 2, may be modular and/or prefabricated for assembly and installation onto the underlying structural substrate 50 on site without temporarily detaching or disassembling the underlying structural substrate 50. The utilization of prefabricated components allows for better quality control of building materials and a resulting higher confidence of the remediated structure in meeting operational performance requirements in the field. In addition, modularity of the reinforcement shell 80, as well as the comparatively light weight of the reinforcement shell 80 to existing solutions, permits improvement in speed of installation. Further, modularity of the reinforcement shell 80 also allows for reduced complexity of construction at a field site thereby reducing human errors in installation. Removing the underlying structural substrate 50, such as a support member of a gold mine stockpile, even temporarily, is undesirable if it renders unusable the structure or building being supported. Specifically, if a structure or building being supported by the underlying structural substrate 50 is temporarily unusable during installation of the reinforcement shell 80 of the reinforced syntactic structure 1 it results in idling of production facilities and potentially sizable lost revenue. Thus, in accordance with embodiments of the present disclosure, the reinforced syntactic structure 1 not only reinforces the existing underlying structural substrate 50, such as a support member, but also eliminates any undesirable downtime during its assembly process through modularity.

Unlike other jacket-type support member protection solutions that are used in the construction industry, which are often non-structural, the reinforced syntactic structure 1 of the present disclosure has been shown to provide quantified engineering improvement to the stability of existing steel or concrete structures/components/members when compared to the underlying structure alone.

Figure 9:
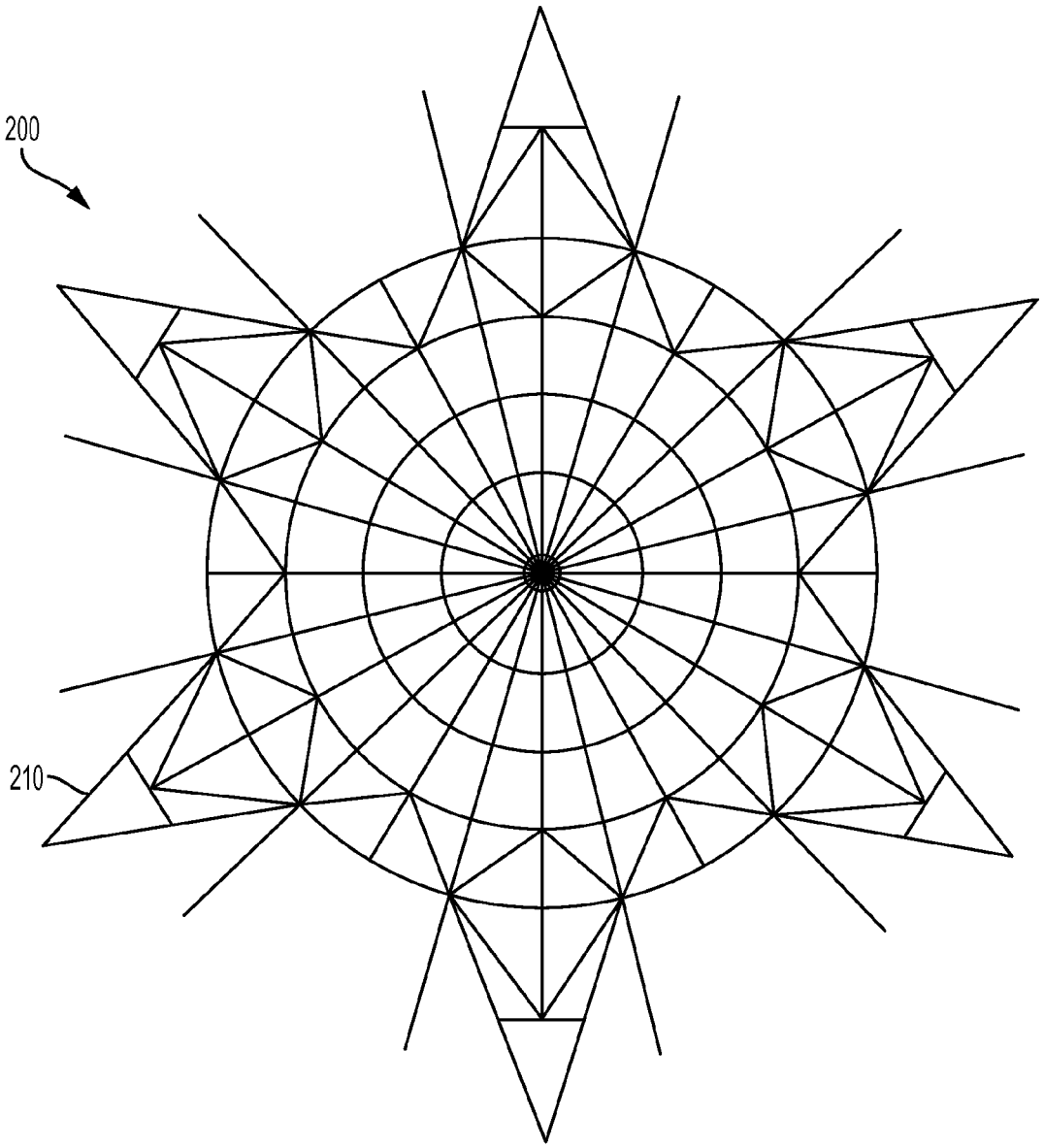
FIG. 9 is schematic view of raking struts and beams in a stockpile cover of a gold mine, wherein the raking struts and beams are exemplary underlying structural substrates that may be reinforced by the embodiments of the present disclosure.

Existing structures are located around the World with concrete or steel structural components or members. Over time and through natural usage and wear the structures experience damage and structural weakening. Placement of the reinforcement shell 80 over the existing structure to form the reinforced syntactic structure 1 allows for the existing structure to be strengthened and remain in service. For example, a stockpile cover 200 for use in a gold mine, as illustrated in FIG. 9, experiences damage, corrosion, and other weakening phenomenon through use and the hostile use environment. Specifically, the raking struts 210 which provide structural support to the stockpile cover 200 frequently exhibit loss of capacity due to damage and corrosion. However, repair or replacement of the raking struts 210 necessitates shut down of the gold mining operation. Thus, placement of a reinforcement shell 80 over the raking struts 210 to form a reinforced syntactic structure 1 is desirable to avoid downtime of the gold mining operations as well as strengthen existing compromised raking struts 210 with corrosion and/or wear.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present disclosure.

It will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these aspects.

The invention claimed is:

1. A reinforced syntactic structure comprising:

an underlying structural substrate having an outer surface; and at least one reinforcement shell, the reinforcement shell comprising:

at least one syntactic foam shell layer encasing at least a portion of the outer surface of the underlying structural substrate and having an unconfined compressive strength of about 500 to about 20,000 psi, wherein the syntactic foam shell layer includes at least two opposing subshells wrapped around the underlying structural substrate, and wherein each opposing subshell comprises at least two ends attached to two respective ends of at least one of the remaining opposing subshells; and at least one rigid non-corrosive stiffening skin coupled to the syntactic foam shell layer having a Young's modulus of 10 GPa to 250 GPa, wherein the rigid non-corrosive stiffening skin includes at least two opposing skin sections attached to the at least two opposing subshells respectively, and wherein each opposing skin section comprises at least two ends attached to two respective ends of at least one of the remaining opposing skin sections;

wherein the syntactic foam shell layer comprises hollow microspheres disposed within a thermosetting or thermoplastic resin matrix.

2. The reinforced syntactic structure of claim 1 wherein at least one end of the opposing skin section comprises at least one flanged end.

3. The reinforced syntactic structure of claim 1 wherein the at least one rigid non-corrosive stiffening skin is coupled to the syntactic foam shell by an adhesive or mechanical fasteners.

4. The reinforced syntactic structure of claim 1 wherein the syntactic foam shell layer has an inner surface adhered to the outer surface of the underlying structural substrate by an adhesive.

5. The reinforced syntactic structure of claim 1 wherein the underlying structural substrate is a tube, beam, pillar, column, plate, or strut.

6. The reinforced syntactic structure of claim 1 wherein the underlying structural substrate comprises metal, concrete, wood, masonry, or combinations thereof.

7. The reinforced syntactic structure of claim 1 wherein the subshells comprise identical or mirrored shapes.

8. The reinforced syntactic structure of claim 1 wherein the subshells have an interior surface which match an exterior surface of the underlying structural substrate.

9. The reinforced syntactic structure of claim 1 wherein the two subshells of the syntactic foam layer are adhered together with an adhesive at an interface of the respective ends, the adhesive having a lap shear strength of 500 psi to 4,400 psi.

10. The reinforced syntactic structure of claim 9 wherein the adhesive comprises epoxy, urethane, acrylate, or combinations thereof.

11. The reinforced syntactic structure of claim 1 wherein the two opposing skin sections are fastened or welded together at respective flanged ends.

12. The reinforced syntactic structure of claim 1 wherein the flanged ends of each skin section overlap with an end of the other skin section attached thereto.

13. The reinforced syntactic structure of claim 1 wherein the rigid non-corrosive stiffening skin comprises stainless steel, galvanized steel, aluminum, carbon fiber reinforced polymer composite, glass fiber reinforced polymer composite or combinations thereof.

14. The reinforced syntactic structure of claim 1 wherein the thickness of the at least one syntactic foam shell layer is 0.25 inches to 6 inches.

15. The reinforced syntactic structure of claim 1 wherein the thickness of the rigid non-corrosive stiffening skin is 0.05 inches to 0.5 inches.

16. The reinforced syntactic structure of claim 1 the rigid non-corrosive stiffening skin has a yield strength of 30,000 psi to 400,000 psi.

17. The reinforced syntactic structure of claim 1 wherein the syntactic foam shell layer with the rigid non-corrosive stiffening skin coupled thereto has a tensile strength of 1,000 to 6,000 psi.

18. The reinforced syntactic structure of claim 1 wherein the syntactic foam shell layer with the rigid non-corrosive stiffening skin coupled thereto has a flexural strength of 500 to 8,000 psi.

19. A method of encasing an underlying structural substrate for remediation, to improve stability, or for remediation and to improve stability comprising providing at least one reinforcement shell comprising at least one syntactic foam shell layer formed from at least two opposing subshells, at least one rigid non-corrosive stiffening skin coupled to the syntactic foam shell layer;

attaching the at least one reinforcement shell around the underlying structural substrate by joining the least two opposing subshells, thereby enclosing the underlying structural substrate;

wherein each opposing subshell comprises at least two ends attached to two respective ends of at least one of the remaining opposing sub shells, the at least one syntactic foam shell layer has an unconfined compressive strength of about 500 to about 20,000 psi, the rigid non-corrosive stiffening skin includes at least two opposing skin sections attached to the at least two opposing subshells respectively, each opposing skin section comprises at least two ends attached to two respective ends of at least one of the remaining opposing skin sections, and the at least one rigid non-corrosive stiffening skin coupled to the syntactic foam shell layer has a Young's modulus of 10 GPa to 250 GPa; and securing the at least one reinforcement shell around the underlying structural substrate by joining the at least two ends of the syntactic foam layer opposing subshells together, fastening or welding the at least two ends of the opposing skin sections together, and adhering an inner surface of the syntactic foam layer to an outer surface of the underlying structural substrate.

20. A reinforcement shell comprising:

at least one syntactic foam shell layer configured to encase at least a portion of an outer surface of a underlying structural substrate and having an unconfined compressive strength of about 500 to about 20,000 psi, wherein the syntactic foam shell layer includes at least two opposing subshells configured to wrap around the underlying structural substrate, and wherein each opposing subshell comprises at least two ends attached to two respective ends of at least one of the remaining opposing sub shells; and at least one rigid non-corrosive stiffening skin coupled to the syntactic foam shell layer having a Young's modulus of 10 GPa to 250 GPa, wherein the rigid non-corrosive stiffening skin includes at least two opposing skin sections attached to the at least two opposing subshells respectively, and wherein each opposing skin section comprises at least two ends attached to two respective ends of at least one of the remaining opposing skin sections;

wherein the syntactic foam shell layer comprises hollow microspheres disposed within a thermosetting or thermoplastic resin matrix.

* * * * *